US008726817B2

(12) United States Patent
Bennett et al.

(10) Patent No.: US 8,726,817 B2
(45) **Date of Patent: *May 20, 2014**

(54) FOLDING TABLE WITH LOCKING MEMBER

(71) Applicant: Lifetime Products, Inc., Clearfield, UT (US)

(72) Inventors: Joel Bennett, Clinton, UT (US); Kent Ashby, Logan, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/846,659

(22) Filed: Mar. 18, 2013

(65) Prior Publication Data

US 2013/0255545 A1 Oct. 3, 2013

Related U.S. Application Data

(63) Continuation of application No. 13/019,942, filed on Feb. 2, 2011, now Pat. No. 8,397,653.

(60) Provisional application No. 61/301,122, filed on Feb. 3, 2010.

(51) Int. Cl.
*A47B 3/00* (2006.01)

(52) U.S. Cl.
USPC ..... 108/115; 108/132

(58) Field of Classification Search
USPC ..... 108/115, 132, 129, 131, 130, 162, 167, 108/168, 169, 172, 171, 173, 174
See application file for complete search history.

(56) References Cited

U.S. PATENT DOCUMENTS

| | | | |
|---|---|---|---|
| 2,747,956 | A | 5/1956 | Saul |
| 3,143,982 | A | 8/1964 | Blink et al. |
| 3,476,061 | A | 11/1969 | Takahashi |
| 4,027,600 | A | 6/1977 | Mueller |
| 4,133,271 | A | 1/1979 | Carlson |
| 5,109,778 | A | 5/1992 | Berkowitz et al. |

(Continued)

FOREIGN PATENT DOCUMENTS

| | | |
|---|---|---|
| EP | 2 030 526 A1 | 3/2009 |
| FR | 1 481 483 | 5/1967 |
| WO | WO 2004/028297 | 4/2004 |

OTHER PUBLICATIONS

U.S. Appl. No. 61/301,122, filed Feb. 2010, Ashby, et al.

(Continued)

*Primary Examiner* — Jose V Chen
(74) *Attorney, Agent, or Firm* — Maschoff Brennan

(57) ABSTRACT

A table may include a table top and a leg assembly. The leg assembly may be moved between use and storage positions, and the movement of the leg assembly may move a cross member between a first position in which the cross member resists folding of the table top and a second position in which the cross member facilitates folding and unfolding of the table top. The table top may include first and second sections with portions that overlap and/or interlock when the table top is unfolded. When the table top is in the unfolded position, movement of the leg assembly towards the use position may move the cross member towards the overlapping and/or interlocking portions, which may move the overlapping and/or interlocking portions towards each other. When moved towards each other, the overlapping and/or interlocking portions may be securely connected.

20 Claims, 15 Drawing Sheets

(56) References Cited

U.S. PATENT DOCUMENTS

| | | | |
|---|---|---|---|
| 5,887,531 | A | 3/1999 | Covill |
| 6,058,853 | A | 5/2000 | Pinch |
| 6,223,661 | B1 | 5/2001 | Griepentrog |
| 6,374,756 | B1 | 4/2002 | Fieldwick et al. |
| 6,615,979 | B2 | 9/2003 | Etherington et al. |
| 6,682,138 | B2 | 1/2004 | Adams et al. |
| 6,752,091 | B2 | 6/2004 | Glover et al. |
| 7,178,468 | B2 | 2/2007 | Winter et al. |
| 7,278,361 | B2 | 10/2007 | Zhurong |
| 7,278,514 | B1 | 10/2007 | Quigley |
| 7,475,641 | B2 | 1/2009 | Jin |
| 7,634,969 | B2 | 12/2009 | Neunzert et al. |
| 7,640,870 | B2 | 1/2010 | Strong et al. |
| 7,703,402 | B2 | 4/2010 | Larcom et al. |
| 7,707,949 | B2 | 5/2010 | Larcom et al. |
| 7,752,982 | B2 | 7/2010 | Lin |
| 7,757,617 | B2 | 7/2010 | Larcom et al. |
| 8,091,490 | B2 | 1/2012 | Branch et al. |
| 8,181,583 | B2 | 5/2012 | Rivera et al. |
| 8,397,653 | B2 | 3/2013 | Ashby et al. |
| 2002/0092445 | A1 | 7/2002 | Glover et al. |
| 2003/0213414 | A1 | 11/2003 | Strong |
| 2004/0094076 | A1 | 5/2004 | Jin |
| 2004/0187749 | A1 | 9/2004 | Zhurong et al. |
| 2005/0029049 | A1 | 2/2005 | Moser et al. |
| 2005/0274302 | A1 | 12/2005 | Jin et al. |
| 2008/0202390 | A1 | 8/2008 | Branch et al. |
| 2008/0216719 | A1 | 9/2008 | Larcom et al. |
| 2008/0245278 | A1 | 10/2008 | Larcom et al. |
| 2008/0282941 | A1 | 11/2008 | Wise |
| 2009/0056593 | A1 | 3/2009 | Farber et al. |
| 2009/0078173 | A1 | 3/2009 | Topham et al. |
| 2009/0078174 | A1 | 3/2009 | Larcom et al. |
| 2009/0293778 | A1 | 12/2009 | Branch |
| 2011/0203493 | A1 | 8/2011 | Ashby et al. |
| 2012/0024203 | A1 | 2/2012 | Winter et al. |
| 2012/0111242 | A1 | 5/2012 | Branch et al. |
| 2012/0210915 | A1 | 8/2012 | Branch et al. |
| 2013/0025509 | A1 | 1/2013 | Jin et al. |

OTHER PUBLICATIONS

U.S. Appl. No. 13/019,942, filed Feb. 2, 2011, Ashby, et al.

U.S. Appl. No. 13/019,947, filed Feb. 2, 2010, Ashby, et al.

International Search Report and Written Opinion from PCT/US2011/023628, dated Mar. 28, 2011.

International Search Report and Written Opinion from PCT/US2011/023638, dated Mar. 30, 2011.

Notice of Allowance from U.S. Appl. No. 13/019,942, dated Nov. 20, 2013.

Office Action from U.S. Appl. No. 13/019,947 dated Feb. 19, 2013.

European Patent Office Supplementary Search Report from EPO Application No. EP 11740366, dated May 6, 2013.

European Patent Office Supplementary Search Report from EPO Application No. EP 11740370, dated May 6, 2013.

FOLDING TABLE WITH LOCKING MEMBER

CROSS-REFERENCE TO RELATED APPLICATIONS

This application is a continuation patent application of U.S. patent application Ser. No. 13/019,942, filed Feb. 2, 2011, now U.S. Pat. No. 8,397,653; which claims priority to and the benefit of U.S. provisional patent application Ser. No. 61/301,122, filed Feb. 3, 2010; each of which is incorporated by reference in its entirety.

BACKGROUND OF THE INVENTION

1. Field of the Invention

The present invention generally relates to tables and, in particular, to tables with legs that can be folded and unfolded and/or tables that can be folded-in-half.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against the table top. Conventional tables with relatively large table tops and folding legs are often referred to as "banquet tables" and these tables are frequently used in assembly halls, banquet halls, convention centers, hotels, schools, churches and other locations where large groups of people meet. These types of tables can often be positioned in an assortment of different configurations and used in a variety of settings. When the banquet tables are no longer needed, the table legs can be moved into the storage position and the tables may be more easily moved or stored.

The table top for many conventional banquet tables retains its same size and shape whether the legs are folded or unfolded. Because most banquet tables have a length between six to ten feet and a width between three to four feet, the required storage area for such tables is quite large even with the legs in the collapsed position. This large storage area may be problematic for businesses or facilities such as hotels, schools and churches because a considerable number of these tables may have to be stored.

In addition, many smaller facilities such as restaurants, offices and homes may have one or more banquet tables. These smaller facilities may use the tables less frequently than the larger facilities, such as only during special occasions. These banquet tables are often too bulky and obstructive to be conveniently stored at such facilities. As a result, it is often necessary for both larger and smaller facilities to rent and/or borrow banquet tables when needed.

Disadvantageously, the process of renting and/or borrowing banquet tables can be inconvenient, time consuming and costly. In addition, conventional banquet tables may be difficult to carry, transport and move. Conventional banquet tables may also be relatively heavy, which may increase the difficulty in carrying, transporting and moving the table.

Conventional banquet tables are often difficult to move or transport because of the length of the table. For example, the length of the table may prevent a single person from easily moving the table and may require the use of two people to move the table. In addition, the extended length of the banquet tables may preclude the tables from being transported in the trunk or back seat of a typical passenger car. Accordingly, banquet tables may have to be transported by a truck or trailer.

It is known to construct banquet tables with table tops that can be folded-in-half, which may allow the tables to be more easily transported and stored. These known fold-in-half tables, however, may unintentionally fold or unfold. These known fold-in-half tables may also require complex and heavy mechanisms to allow the table tops to be folded in half. In addition, fold-in-half tables may require additional support structures and sturdier table tops than conventional table tops, which may undesirably increase the weight and cost of the table. Further, when conventional fold-in-half tables are in the use position, the two halves of the table top may not be properly aligned and a weak spot may be undesirably formed at the center of the table. Finally, conventional fold-in-half tables may require the user to perform multiple tasks to correctly position the legs and the table top, and lock the legs and/or table top in the desired position.

BRIEF SUMMARY OF THE INVENTION

A need therefore exists for a table that reduces or eliminates the above-described or other disadvantages and problems.

One aspect is a table that may include a table top and one or more legs or support pedestals sized and configured to support the table top above a surface. The legs may be movable between an extended or use position in which the legs support the table top above a surface, and a collapsed or storage position in which the legs are disposed at least adjacent or proximate the table top. Advantageously, when the legs are in the use position, the table may be used to support a wide variety of objects and the table may be used for a variety of different purposes.

Another aspect is a table that may include a table top which is capable of being moved between folded and unfolded positions. For example, the table top may be a fold-in-half table top with two sections that may be generally aligned in the same plane when the table top is in the unfolded position and, when the table top is in the folded position, the sections may be positioned generally adjacent and parallel to each other. If desired, the two sections may be connected using hinges or other structures to allow the sections to move between the folded and unfolded positions. The table may also include legs that are movable between extended and collapsed positions. Advantageously, if the table includes both a foldable table top and legs that can be selectively moved between use and storage positions, then the table may be disposed or stored in a relatively small area. This may allow, for example, a single person to easily move and transport the table. In addition, this may allow the table to be disposed in a compact area, such as the backseat or trunk of an automobile. Further, this may allow one or more tables to be shipped and stored in a limited amount of space, which may decrease transportation and storage costs.

Yet another aspect is a table that may include a table top and a frame. The table top may be capable of moving between folded and unfolded positions, and the frame may be connected to the table top. For example, the frame may include a first section connected to a first portion of the table top and a second section connected to a second portion of the table top. The first and second sections of the frame may be connected by hinges or other suitable structures, which may facilitate folding and unfolding of the table top.

Still another aspect is a table that may include a locking mechanism which locks the table top in the unfolded position. For example, the locking mechanism may lock a portion of the frame, such as a hinge, in a fixed position to prevent folding of the table top. In the unlocked position, the locking mechanism may allow the table top to be folded or unfolded about the hinge.

A further aspect is a table that may include legs movable between extended and collapsed positions, and a locking mechanism that locks the table top in the unfolded position. Desirably, when the legs are in the extended position, the locking mechanism locks the table top in the unfolded position. In addition, movement of the legs between the extended and collapsed positions preferably moves the locking mechanism into the locked and unlocked positions. For example, when the legs are moved into the extended position, this may lock the locking mechanism. On the other hand, when the legs are moved into the collapsed position, this may unlock the locking mechanism. Significantly, this may allow the table to be more quickly and easily used because the user may simply move the legs into the extended position and this may lock the table top in the unfolded position. This may also make the table easier to move and store because the user only has to move the legs into the collapsed position and this unlocks the table top so that it can be folded in half.

Yet another further aspect is table that may include a locking mechanism with a locking member. The locking member may consist of a tube, rod, pin or the like, and the movement of the legs may move the locking member between locked and unlocked positions. For example, when the legs are moved to the collapsed position, this may move the locking member into the unlocked position. On the other hand, when the legs are moved to the extended position, this may move the locking member to the locked position. Preferably, movement of the legs simultaneously moves the locking member, which may allow the locking mechanism to be rapidly locked and unlocked.

A still further aspect is a table that may include a cross member which locks the table top in the unfolded or use position. For example, the table may include a table top with two sections connected by one or more hinges and the hinges may include openings in which a portion of the cross member is disposed. The table may also include a brace assembly that interconnects the cross member and the legs. The brace assembly is preferably sized and configured so that when the legs are moved between the extended and collapsed positions, the cross member moves within the openings in the hinges. The brace assembly desirably moves the cross member into the unlocked position when the legs are in the collapsed position, and the brace assembly moves the cross member into the locked position when the legs are in the extended position. Advantageously, the cross member may simultaneously lock and/or unlock multiple hinges, if desired. For instance, the cross member may concurrently lock and/or unlock a first hinge on one side of the table and a second hind on a second side of the table, which allow a stronger and sturdier table to be created.

Another aspect is a table that may include a cross member which is movable relative to the table top. For example, the cross member may be disposed in a first position in which it is spaced apart from a lower portion of the table top by a distance. The cross member may also be disposed proximate or adjacent the lower portion of the table top when the cross member is in a second position. If desired, the table top may be disposed in an unlocked position when the cross member is in the first position and the table top may be disposed in the locked position when the cross member is in the second position. Advantageously, the movable cross member may allow a table top with a lower or thinner profile to be created. For instance, because all or a portion of the cross member may be disposed above a plane generally aligned with a lower surface of the table top and closer to the upper surface of the table top when the cross member is in the second position, this may allow a lower profile table top to be created. In addition, the structure used to receive and position the cross member may be smaller and/or have a decreased height, which may also help create a lower profile table top. Further, the table top may include features, such as a lip, to be shorter and/or smaller than a conventional table top. The smaller profile table top may significantly reduce the amount of material required to make the table top, decrease the weight of the table, and help cut material and/or manufacturing costs.

Still another aspect is a table that may include a cross member connected to the frame by a connector. The connector may include a first portion connected to the cross member and a second portion connected to a portion of the frame, such as a hinge. The first portion of the connector may include a passage or opening through a portion of the cross member may be disposed and the cross member may be secured to the connector. The second portion of the connector may be connected to the hinge using a pivot pin or other suitable structures.

A further aspect is a table that may include a pair of legs and an interconnecting support. The support may have a generally curved shape that extends upwardly towards the table top when the legs are in the extended position. Significantly, the support may help provide greater stability along a greater portion of the length of the legs. In addition, the support may help provide increased leg room. The legs may have a generally tapered shape, if desired.

A still further aspect is a table that may include a handle formed in the table top. The handle may be integrally formed in the table top as part of a unitary, one-piece structure. Advantageously, the handle may not require any separate or secondary pieces or structures. In greater detail, the table top may include two sections and, when the table top sections are in a folded position, an access opening in an outer edge of the first table top section may be generally aligned with a recess in an outer edge of the second table top section. This may allow the recess to be easily grasped as a handle when the table top is folded. In addition, the gripping area of the handle is preferably disposed between the edge of the table top and the frame, and the handle and access opening preferably have a length that is at least about three to four inches in length.

Another aspect is a table that may include a table top constructed from a relatively lightweight material, such as blow-molded plastic. The edge of the blow-molded plastic table top may include arched, angled, chamfered or tapered upper and/or lower portions. For example, angled upper and lower portions of the edge of the table top may be vertically aligned and overlapping. Tack-offs or depressions may be disposed in the angled upper and lower portions of the edge, which may increase the strength and impact resistance of the edge. This may allow the size of the lip to be significantly decreased or eliminated, which may further decrease the height or thickness of the lip. In addition, because the edge may be thinner, the plastic has a shorter distance to travel during the manufacturing process. Advantageously, this may make the table top easier to form during the manufacturing process and it requires less plastic because of its smaller size. Because this edge configuration may allow the table top to be molded with less plastic, this may decrease the weight of the table top and reduce the amount of plastic required, which may reduce the cost of the table.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards tables and, in particular, to fold-in-half tables with folding legs. The principles of the present invention, however, are not limited to fold-in-half tables with folding legs. It will be understood that, in light of the present disclosure, the tables disclosed herein can have a variety of shapes, sizes, configurations and arrangements. In addition, while the tables shown in the accompanying figures are banquet or utility tables, it will be appreciated the table may have any suitable style or configuration such as round, personal, conference or card tables. Further, the invention disclosed herein may be successfully used in connection with other types of furniture and/or structures.

Additionally, to assist in the description of preferred embodiments of the tables, words such as top, bottom, front, rear, right and left may be used to describe the accompanying figures which may be, but are not necessarily, drawn to scale. It will further be appreciated that the tables can be disposed in a variety of desired positions or orientations, and used in numerous locations, environments and arrangements. A detailed description of preferred embodiments the table now follows.

Figure 1:
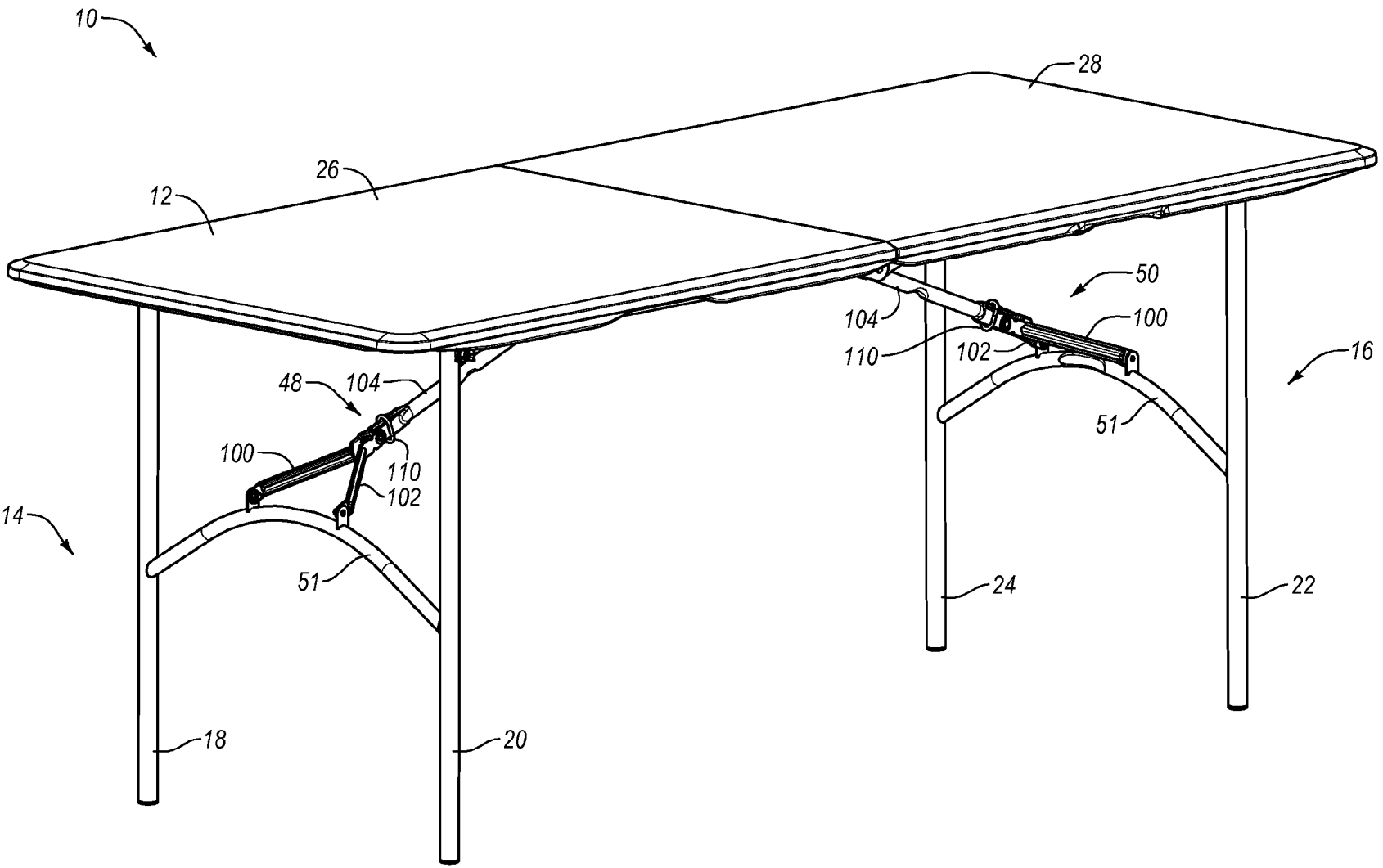
FIG. 1 is an upper perspective view of an exemplary table, illustrating a table top in an unfolded position and legs in a use position.

As shown in FIG. 1, a table 10 may include a table top 12 and one or more leg assemblies 14, 16, which may include one or more legs or supports 18, 20, 22, 24 (which may be collectively or individually referred to as legs or leg assemblies). The legs 18, 20, 22, 24 may have a tapered shape that tapers towards a distal end of the legs. The tapered shape may be formed, for example, using a doming process or other suitable process. It will be appreciated the legs and leg assemblies 14, 16, 18, 20, 22, 24 may have other suitable shapes, sizes, configurations and arrangements depending, for example, upon the intended use of the table 10.

Figure 2:
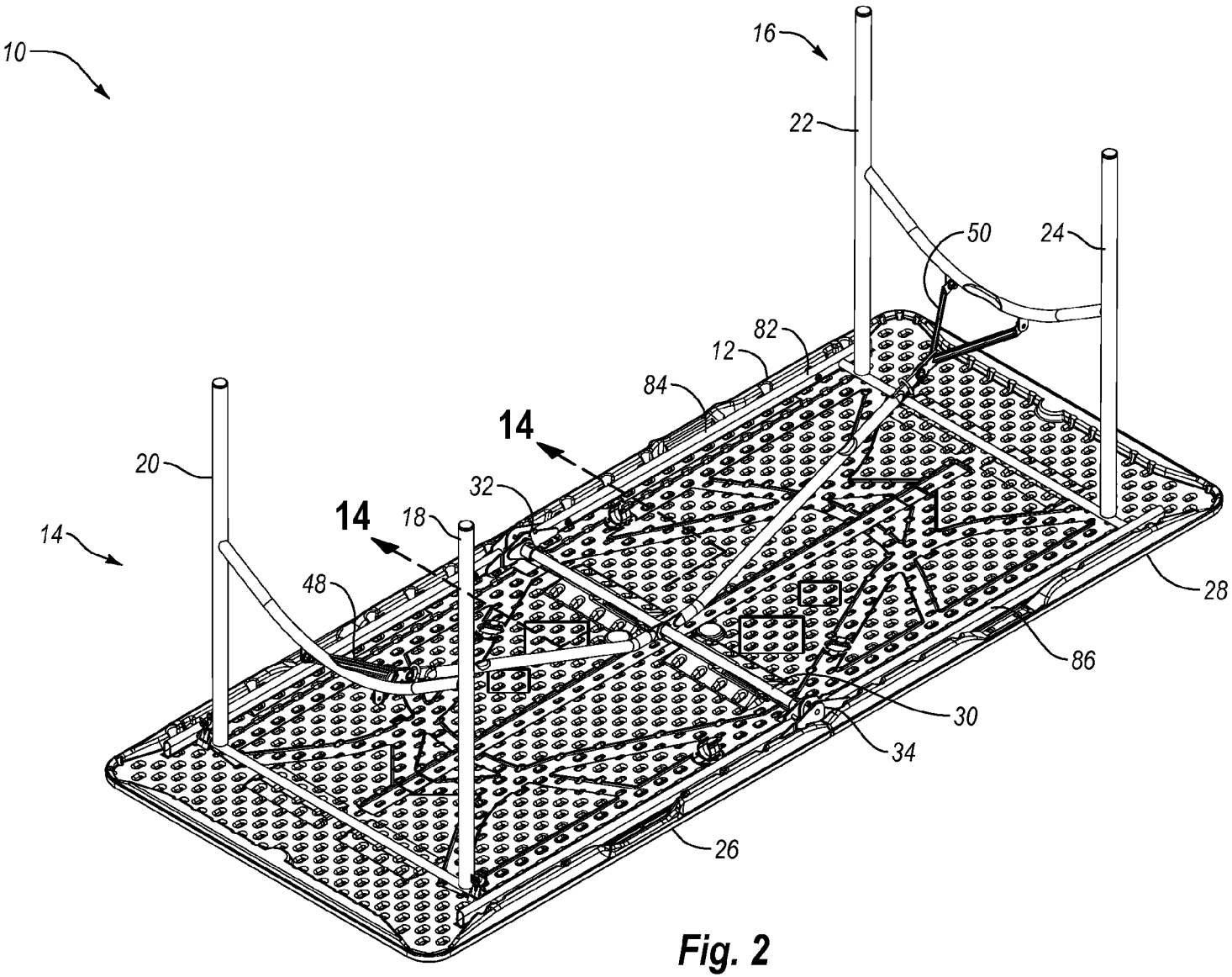
FIG. 2 is a lower perspective view of the table shown in FIG. 1.
Figure 3:
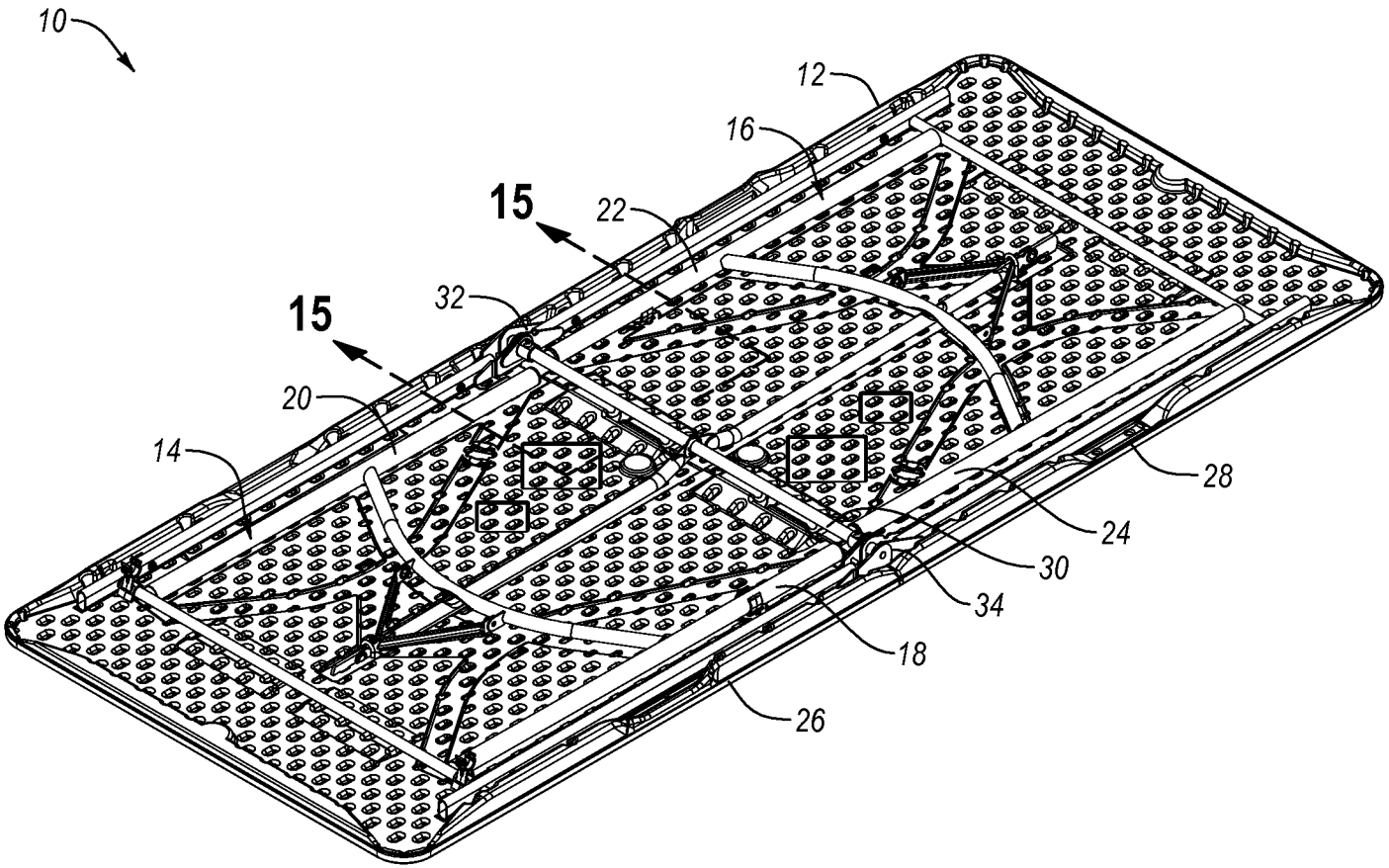
FIG. 3 is a lower perspective view of the table shown in FIG. 1, illustrating the legs in a collapsed position.

As shown in FIGS. 2 and 3, the leg assemblies 14, 16 may be movable between an extended or use position and a collapsed or storage position relative to the table top 12. For example, the table top 12 may include a first section 26 and the leg assembly 14 may be movable between the extended and collapsed positions relative to the first section of the table top. Similarly, the table top 12 may include a second section 28 and the leg assembly 16 may be movable between the extended and collapsed positions relative to the second section of the table top.

Figure 4:
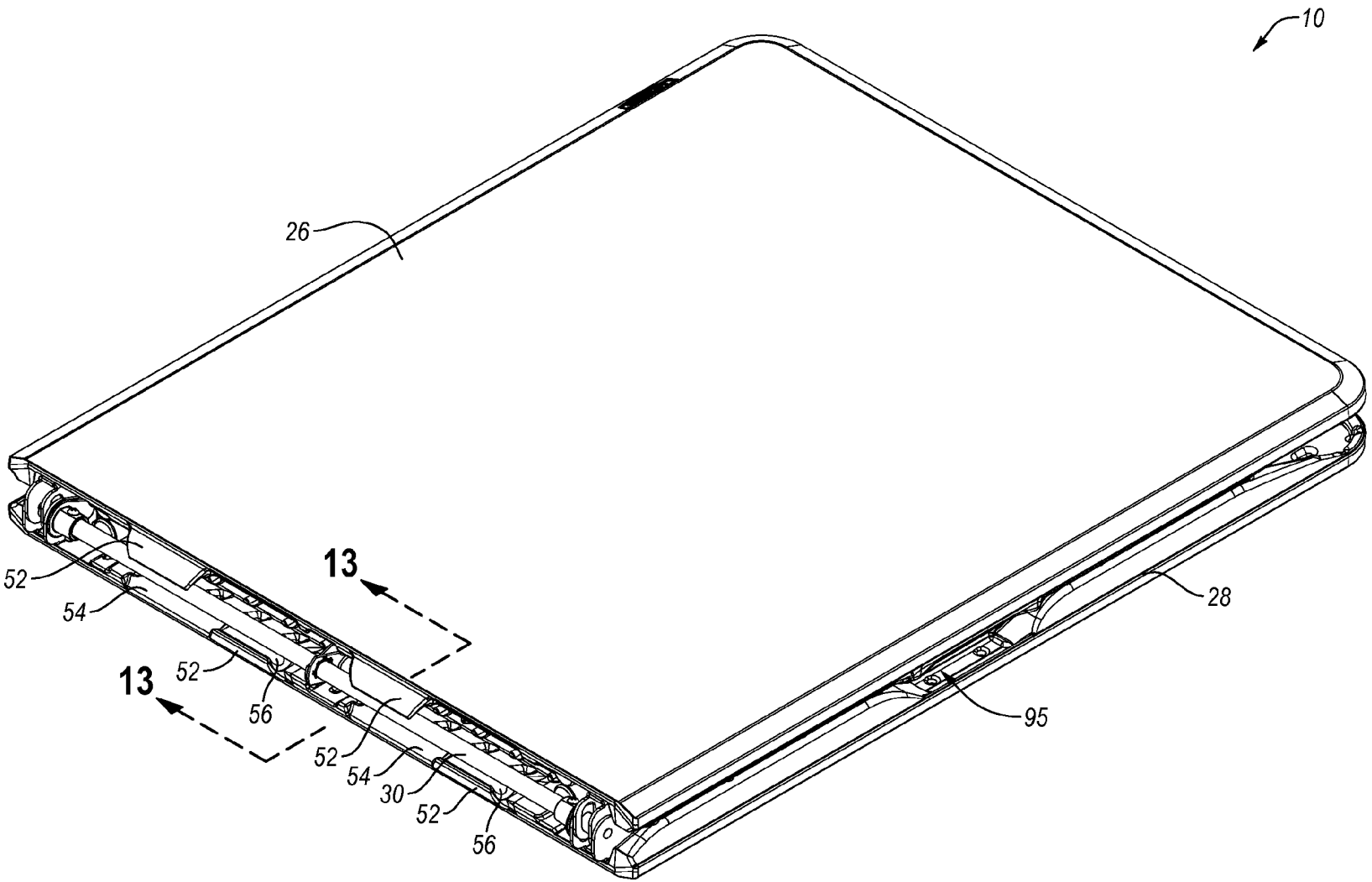
FIG. 4 is an enlarged upper perspective view of the table shown in FIG. 1, illustrating the table top in a folded position.

The table top 12 may also be foldable about an axis between an unfolded position, such as shown in FIG. 3, and a folded position shown in FIG. 4. The first and second sections 26, 28 are preferably generally aligned in the same plane when the table top 12 is in the unfolded position, and the table top sections are preferably disposed generally adjacent and parallel to each other when in the folded position.

The table 10 may include a locking mechanism that prevents unintentional folding of the table top 12. In particular, the locking mechanism may lock the table top 12 in the unfolded position as shown in FIG. 1. When the locking member is in the unlocked position, the table top 12 to be readily folded and unfolded.

The locking mechanism may include a locking member, such as a tube, rod, pin or the like, which is movable between a first, locked position in which the locking member resists folding of the table top 12 and a second, unlocked position in which the table top may be fold and unfolded. In greater detail, as shown in FIG. 2, the table 10 may include a cross member 30 that extends across a portion of the table top 12. The cross member 30 may form at least a portion of the locking member of the locking mechanism. For example, when the cross member 30 is in the first position, the table top 12 may be locked in the unfolded position. When the cross member 30 is in the second position, the table top 12 may be moved between the folded and unfolded positions.

In greater detail, the first and second sections 26, 28 of the table top 12 may rotate about an axis between the folded and unfolded positions. When the cross member 30 is in the first, locked position, the cross member may not be aligned with the axis of rotation of the table top 12. Because the cross member 30 and the axis of rotation are not aligned, the table top 12 may locked in a fixed position. On the other hand, when the cross member 30 is in the second, unlocked position, then the cross member and axis of rotation may be aligned which allows the table top 12 to be folded and unfolded.

The table 10 preferably includes one or more hinges 32, 34 to allow the first and second table top sections 26, 28 to move between the unfolded and folded positions. For example, as seen in FIGS. 5-10, the hinges 32, 34 may include a first portion 36 connected to the first section 26 of the table top 12 and a second portion 38 connected to the second section 28 of the table top 12. As shown in the drawings, the first and second portions 36, 38 of the hinges 32, 34 may be connected to a frame and, in particular, to elongated supports or rails of the frame.

The first and second portions 36, 38 of the hinges 32, 34 are connected by a fastener 40. The first and second portions 36, 38 of the hinges 32, 34 are preferably pivotally or rotatably connected by the fastener to allow the first and section table top sections to move between the folded and unfolded positions about an axis of rotation aligned with the fasteners 40.

As discussed above, the cross member 30 may be movable between a first, locked position and a second, unlocked position. Desirably, when the table top 12 is in the unfolded position, the cross member 30 may be moved between the first and second positions. For example, when the table top 12 is in the unfolded position, the cross member 30 may be moved between the first position as shown in FIGS. 5-7 and 14 and the second position as shown in FIGS. 8-10 and 15. When the cross member 30 is in the first position as shown in FIGS. 5-7 and 14, the cross member 30 is preferably offset from the axis of rotation of the table top 12. In particular, the cross member 30 is preferably spaced apart from the axis of rotation of the table top 12 by a distance.

Figure 7:
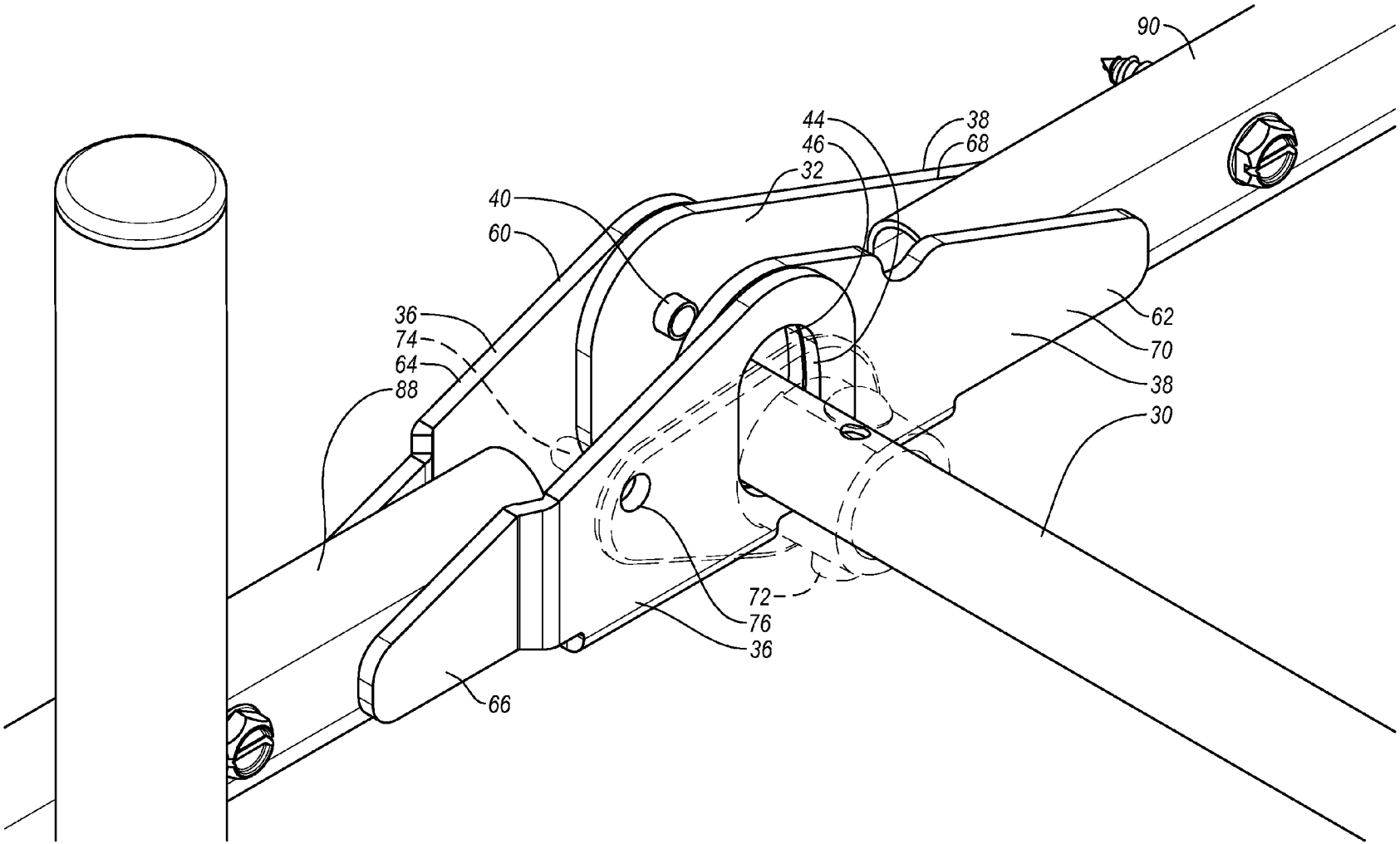
FIG. 7 is another perspective view of a portion of the table shown in FIG. 6, illustrating a portion of the table in broken lines.
Figure 8:
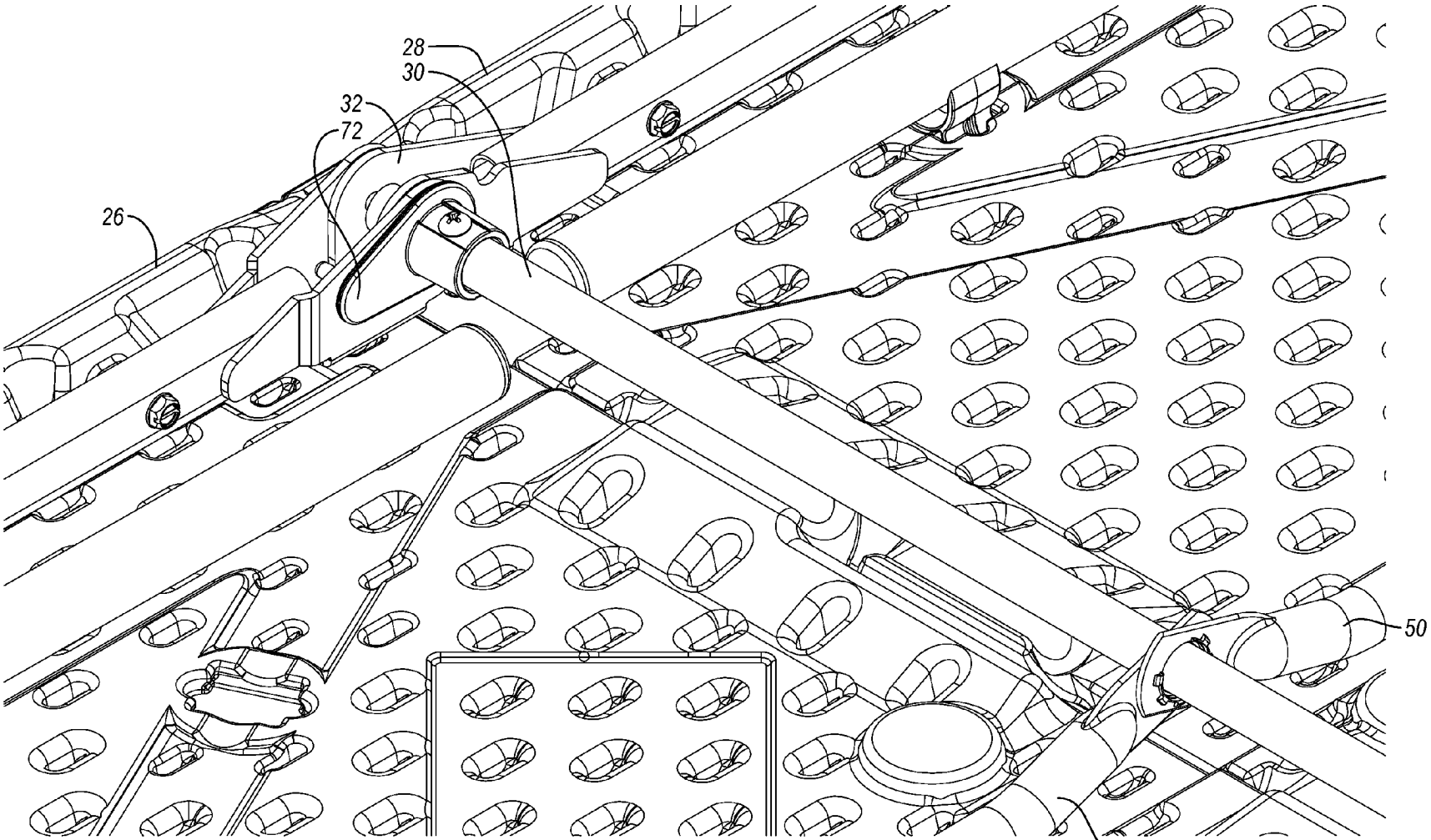
FIG. 8 is an enlarged lower perspective view of a portion of the table shown in FIG. 1.
Figure 9:
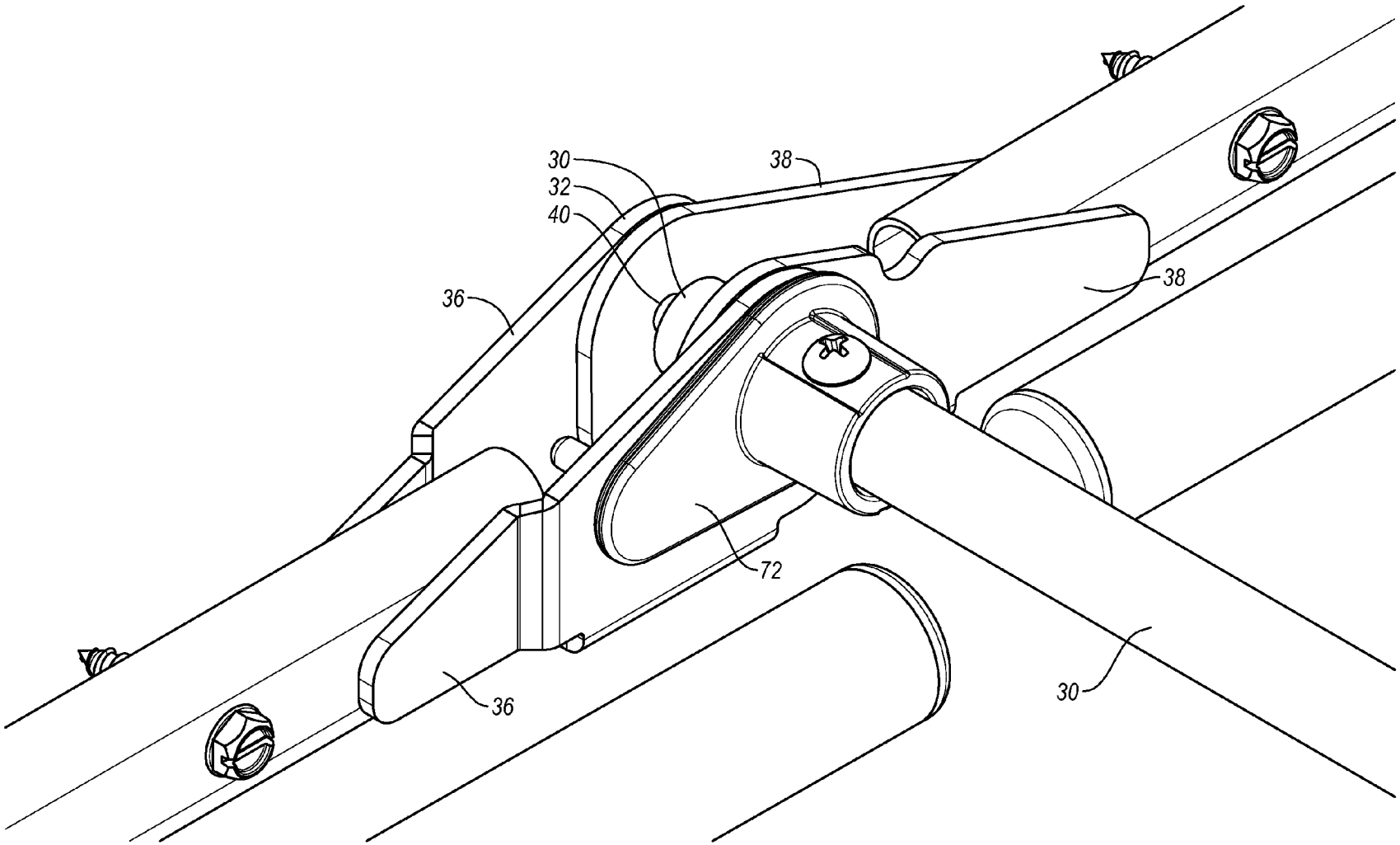
FIG. 9 is an enlarged perspective view of a portion of the table shown in FIG. 8.

In greater detail, as shown in FIG. 7, the cross member 30 may include an end 42 that is disposed within an opening 44 in the first portion 36 of the hinge 32 and a second opening 46 in the second portion 38 of the hinge. The cross member 30 is preferably disposed within the openings 44, 46 such that the cross member 30 is not aligned with the axis of rotation aligned with the fastener 40 when the cross member is in the first, locked position. Because the cross member 30 is not aligned with the axis of rotation about the fastener 40, the cross member may resist folding of the table top 12.

As shown in FIG. 7, the hinge 32 may include a pair of first portions 36 and a pair of second portions 38. The pairs of the first and second portions 36, 38 may be spaced apart by a distance. For example, the pairs of the first and second portions 36, 38 may be disposed on opposing sides of the frame, such as the rails. As illustrated in the figures, the opening 44 may be disposed in only one of the two first portions 36 of the hinge 32 and the opening 46 may be disposed in only one of the two second portions 38 of the hinge. In addition, the fastener 40 may only connect one of the first and second portions 36, 38 of the hinge 32. It will be appreciated the hinge 32 may have other suitable shapes, sizes, configurations and arrangements. For example, the opening 44 may be disposed in both of the first portions 36 of the hinge 32 and/or the opening 46 may be disposed in both of the second portions 38 of the hinge. In addition, the fastener 40 may connect any desired portions of the hinge.

Figure 10:
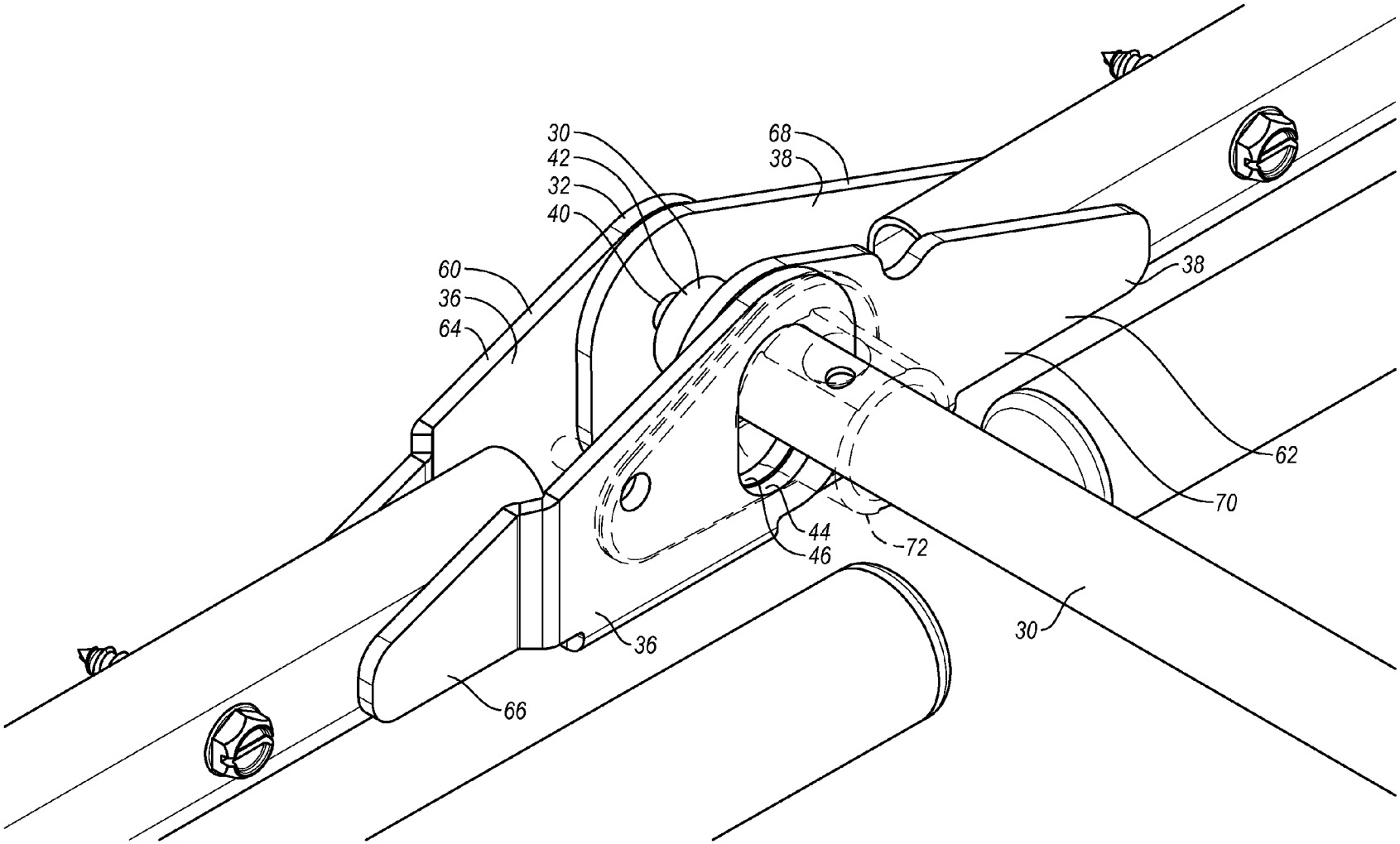
FIG. 10 is another perspective view of a portion of the table shown in FIG. 9, illustrating a portion of the table in broken lines.

As shown in FIGS. 8-10 and 15, the cross member 30 may be aligned with the axis of rotation of the first and second sections 26, 28 of the table top 12. In particular, as shown in FIG. 10, the end 42 of the cross member 30 may be positioned in a second position within the openings 44, 46 in the hinge 32. Preferably, when the cross member 30 is in the second position, the cross member is aligned with the pivot axis formed by the fastener 40. Desirably, when the cross member 30 is disposed in the second positioned within the openings 44, 46 and aligned with the pivot axis of the hinge 32, then the cross member may facilitate folding and unfolding of the table top 12.

As shown in FIG. 2, the table 10 may include two hinges 32, 34 and the hinges may be disposed on different sides of the table top 12. For example, the first hinge 32 may be disposed on a first side of the table top 12 and the second hinge 34 may be disposed on a second side of the table top. If desired, a first end 42 of the cross member 30 may be disposed within the openings 44, 46 of the hinge 32 and a second end of the cross member may be disposed within the openings of the hinge 34. This may advantageously help create a stronger and/or more secure table 10 because both sides of the table may be connected by hinges and both hinges may be locked in the unfolded position. It will be appreciated that any suitable number of hinges may be used and any number of hinges may be locked in position depending, for example, upon the intended use of the table 10.

The movement of the cross member 30 between the first and second positions is preferably controlled by the movement of the legs 14, 16. For instance, when the legs are moved between the extended and collapsed positions, the cross member 30 may be moved between the first and second positions. In particular, moving the legs 14, 16 from the extended position to the collapsed position may move the cross member 30 from the first position shown in FIGS. 7 and 13, in which the cross member resists folding of the table top 12, to the second position shown in FIGS. 10 and 14, in which the cross member facilitates folding and unfolding of the table top. On the other hand, moving the legs 14, 16 from the collapsed position to the extended position may move the cross member 30 from the second position to the first position, and the cross member may now resist folding and unfolding of the table top 12.

In further detail, brace assemblies may be used to connect the legs 14, 16 and the cross member 30. Advantageously, these brace assemblies may be used to control the movement of the cross member 30 when the legs 14, 16 are moved between the extended and collapsed positions. For example, as shown in FIG. 1, the table 10 may include a first brace assembly 48 with a first portion connected to the leg 14 and a second portion connected to the cross member 30. The table 10 may also include a second brace assembly 50 with a first portion connected to the leg 16 and a second portion connected to the cross member 30.

Figure 5:
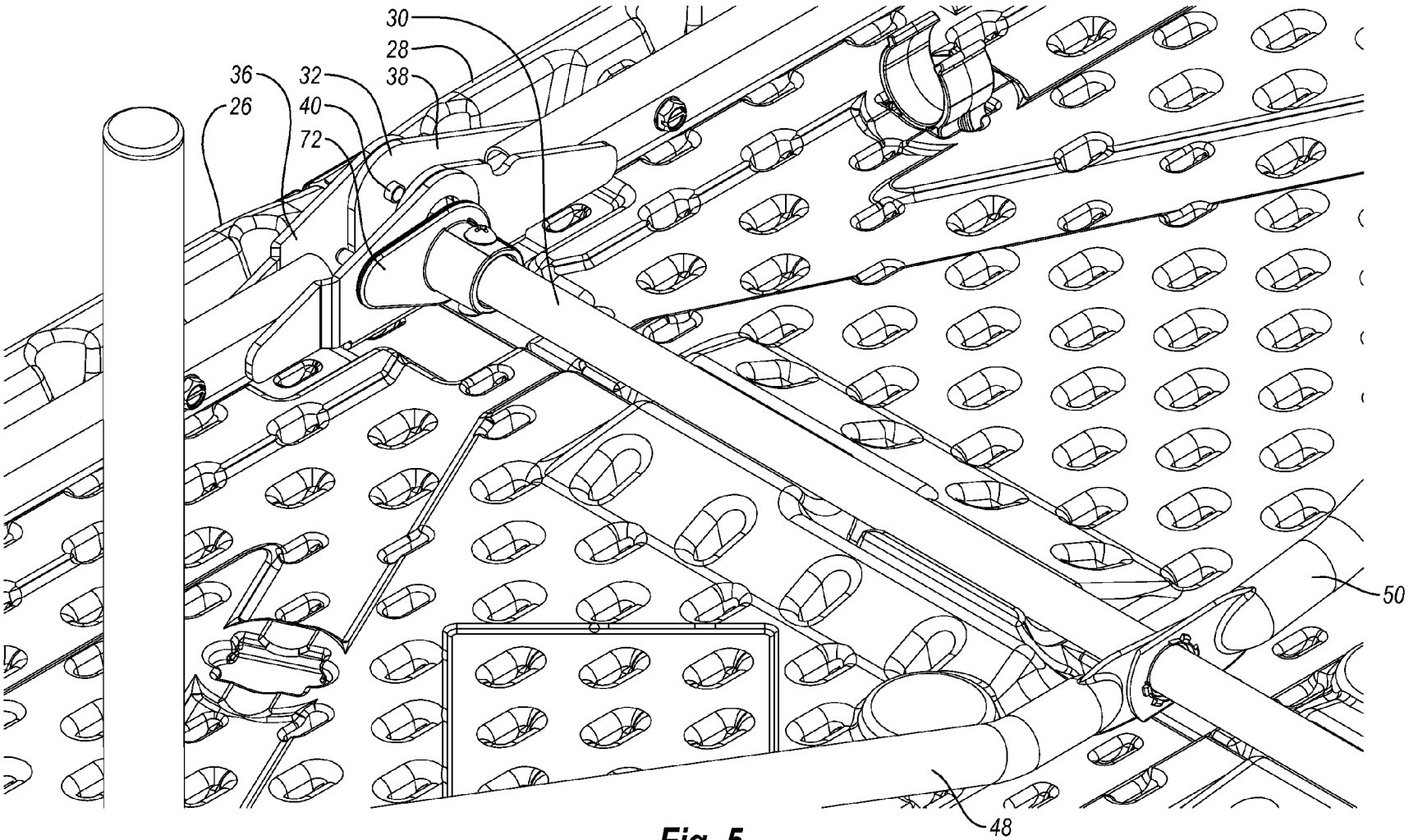
FIG. 5 is an enlarged lower perspective view of a portion of the table shown in FIG. 1.

As discussed in greater detail below, the ends of the brace assemblies connected to the cross member 30 are preferably angled relative to the elongated body of the brace. For instance, as seen in in FIG. 2, when the legs 14, 16 and the brace assemblies 48, 50 are in the use positions, the elongated body of the brace is disposed at an angle (preferably between about 30 and about 60 degrees, or approximately 45 degrees) relative to the lower surface of the table top 12. The ends of the brace assemblies 48, 50 connected to the cross member 30 are preferably disposed more parallel to the lower surface of the table top 12 than the elongated body. For example, the ends of the brace assemblies 48, 50 may be disposed generally parallel to the lower surface of the table top 12, as shown in FIG. 5, when the brace assemblies 48, 50 are in the use position. This configuration of the brace assemblies 48, 50 may help position the cross member 30 in the first position when the legs 14, 16 are in the extended position.

When the brace assemblies 48, 50 are in the collapsed position, as shown in FIG. 3, the elongated body is preferably disposed generally parallel to the lower surface of the table top 12 and the end connected to the cross member 30 is preferably angled outwardly and away from the lower surface of the table top. Desirably, this may cause the cross member 30 to be positioned in the second, unlocked position.

The other end of the brace assemblies 48, 50 may be connected to a support member 51. In particular, the first leg assembly 14 may include a first support member 51 connected to the legs 18, 20 and the second leg assembly 16 may include a second support member 51 connected to the legs 22, 24. The first portion of the first brace assembly 48 may be connected to the first support 51 member and the first portion of the second brace assembly 50 may be connected to the second support member 51.

The support members 51 preferably curve upwardly towards the table top 12 when the legs 14, 16 are in the extended position, which may advantageously provide additional leg room. In addition, the support members 51 may have a height that is at least ten percent, twenty percent, thirty percent, forty percent, fifty percent or more of the height of the legs 18, 20, 22, 24. Desirably, this may allow the support members 51 to provide increased lateral support for the legs 18, 20, 22, 24. It will be appreciated the support members 51, which are not be required, may have other suitable shapes, sizes, arrangements and configurations. Further, the brace assemblies 48, 50 may be connected to other suitable portions of the leg 14, 16.

Figure 13:
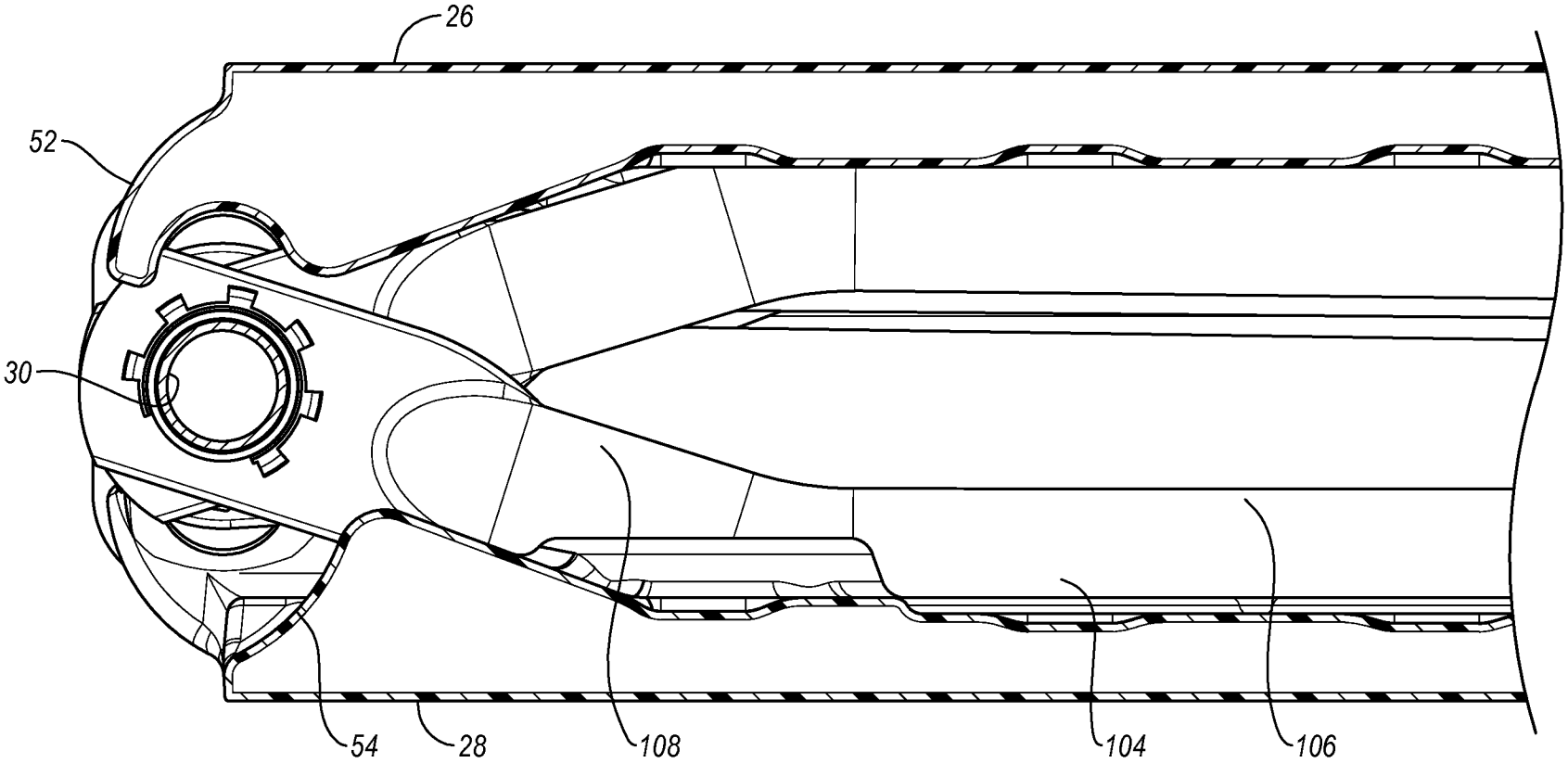
FIG. 13 is a cross-sectional view of a portion of the table shown in FIG. 1.
Figure 14:
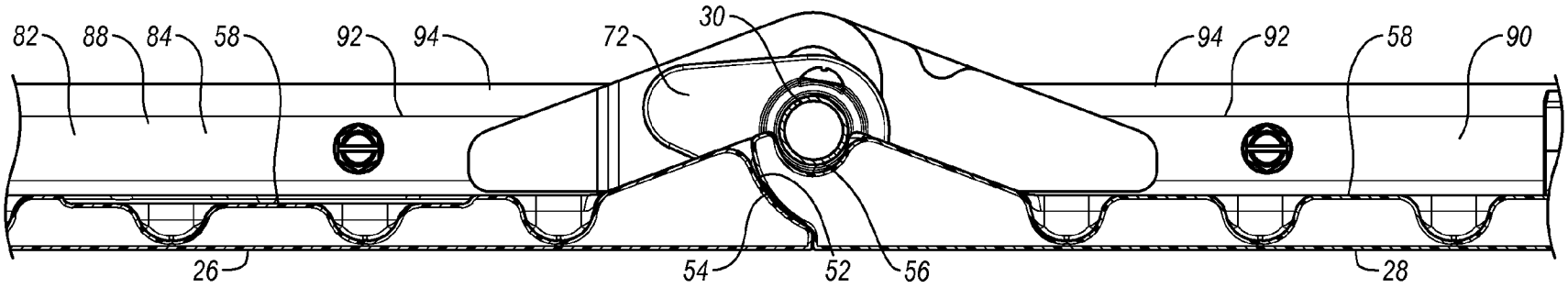
FIG. 14 is still another cross-sectional view of a portion of the table shown in FIG. 1.

In summary, the brace assemblies 48, 50 may connect the legs 14, 16 and the cross member 30 and, when the legs are moved between the extended and collapsed positions, this may cause the brace assemblies 48, 50 to move between the use and collapsed positions. This movement of the brace assemblies 48, 50 may move the cross member 30 between the first and second positions. In particular, moving the legs 14, 16 from the extended to the collapsed position may move the corresponding brace assembly 48, 50 from the use to the storage position. This movement of the brace assemblies 48, 50 may help move the cross member 30 from the first, locked position (as shown in FIGS. 7 and 13) to the second, unlocked position (as shown in FIGS. 10 and 14). On the other hand, when the legs 14, 16 are moved from the collapsed to the extended position, this may move the brace assemblies 48, 50 from the storage to the use position. This movement of the brace assemblies 48, 50 may move the cross member 30 from the second, unlocked position to the first, locked position. It will be understood the legs 14, 16, the brace assemblies 48, 50 and/or the cross member 30 may move in other ways or manners depending, for example, upon the particular arrangement, configuration or intended use of the table 10.

Desirably, when the table top 12 is in the unfolded position, portions of the first and second sections 26, 28 of table top engage, contact, touch or support each other. For example, the first and second sections 26, 28 of the table top 12 may include one or more receiving and engaging portions, which may make a stronger and/or sturdier table top. These receiving and engaging portions may overlap and/or interlock when the first and second table top sections 26, 28 are in the unfolded position, which may increase the strength and/or rigidity of the center portion of the table 10.

Figure 11:
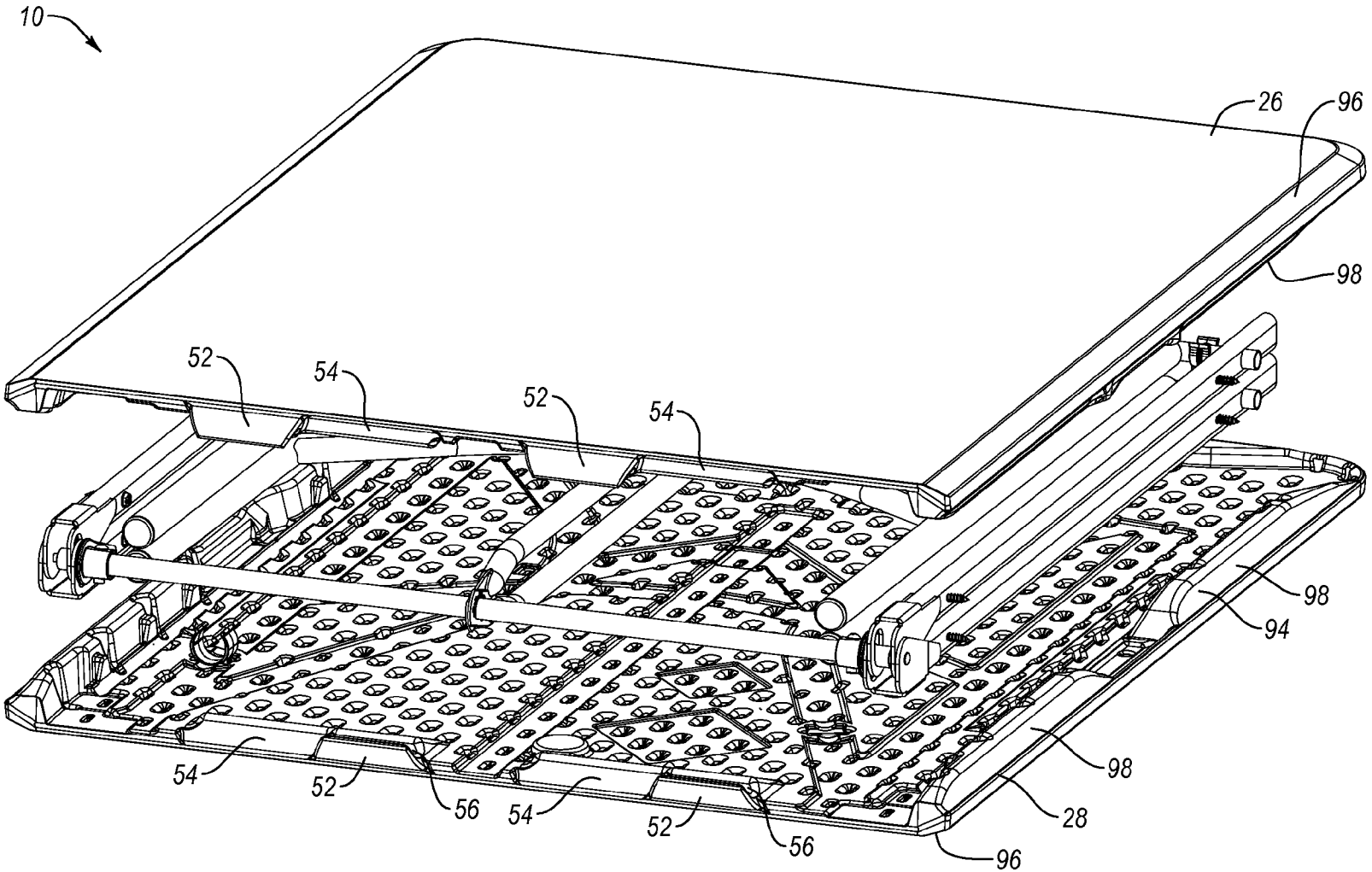
FIG. 11 is a partially exploded view of the table shown in FIG. 1.

For example, as shown in FIG. 11, the table top 12 may include receiving portions 52 and engaging portions 54 disposed along an inner edge of the first and second sections 26, 28 of the table top. As shown in the accompanying figures, a portion of the receiving portions 52 may extend outwardly and away from the first and second sections 26, 28 of the table top 12 while a portion of the engaging portions 54 may extend inwardly towards the body of the first and second table top sections. When the table top sections 26, 28 are in the folded position, the receiving portions 52 may be spaced apart from the engaging portions 54. Preferably, when the first and second table top sections 26, 28 are in the unfolded position, the receiving portions 52 overlap, contact and/or engage the receiving portions 54. The receiving and engaging portions 52, 54 may also interlock or be interconnected when the first and second table top sections 26, 28 are in the unfolded position.

In greater detail, the receiving portions 52 may include a projection and the engaging portions 54 may include a corresponding recess that is sized and configured to receive the projection with the table top 12 is in the unfolded position. Advantageously, the receiving and engaging portions 52, 54 may help align the first and second table top sections 26, 28 when the table top 12 is in the unfolded position. In addition, the receiving and engaging portions 52, 54 may help position the first and second table top sections 26, 28 in a desired configuration when the table top 12 is in the unfolded position. Further, the receiving and engaging portions 52, 54 may help pull the first and second table top sections 26, 28 together when the table top 12 is in the unfolded position.

Figure 15:
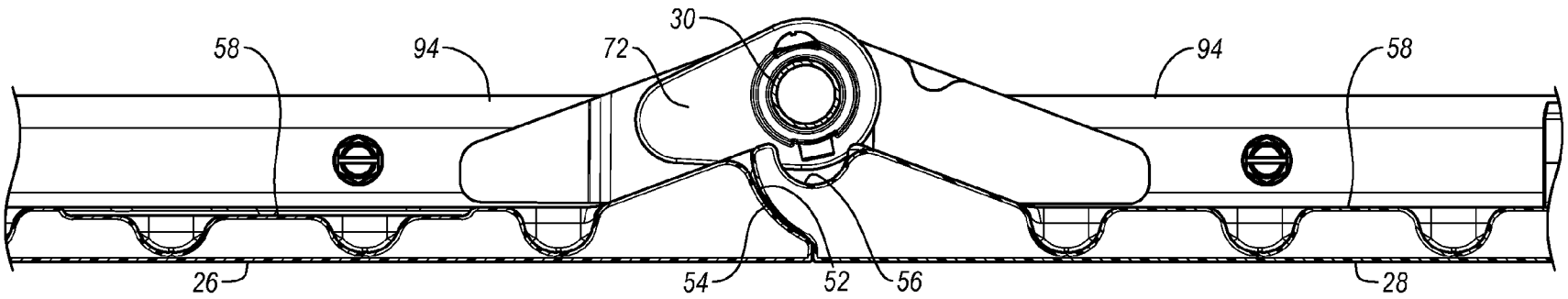
FIG. 15 is yet another cross-sectional view of a portion of the table shown in FIG. 1.

For example, as shown in FIG. 15, when the cross member 30 is disposed in the second position, the cross member may be spaced apart from the lower portion of the table top 12 by a distance. In particular, the cross member 30 may be spaced apart from the receiving and engaging portions 52, 54 by a distance. When the cross member 30 is moved into the first position as shown in FIG. 14, the cross member 30 may contact, abut and/or engage the receiving portions 52. The engagement of the cross member 30 with the receiving portions 52 may help create a friction or interference fit between the receiving and engaging portions. The engagement of the cross member 30 with the receiving portions 52 may also cause a portion of the receiving and/or engaging portions 52, 54 to resiliently deform, deflect and/or compress, which may advantageously help reduce or eliminate any gaps or spaces between the table top sections 26, 28. In addition, when the cross member 30 engages the receiving portions 52, that may bias the receiving portions of the second table top section 28 towards the engaging portions 54 of the first table top section 26. Likewise, when the cross member 30 engages the receiving portions 52 of the first table top section 26, that may bias the receiving portions of the first table top section 26 towards the engaging portions 54 of the table top section 28. Thus, the cross member 30 may help securely connected the first and second table top sections 26, 28 when the table top 12 is in the unfolded position.

The receiving portions 52 may include a recess 56, such as groove, notch or the like, that is sized and configured to receive the cross member 30, such as shown in FIGS. 13 and 14. As shown in FIG. 14, when the cross member 30 is in the first, locked position, the cross member may be at least partially disposed in the recess 56. As shown in FIG. 15, when the cross member 30 is in the second, unlocked position, then the cross member 30 may be spaced apart from the recess 56.

As shown in FIG. 14, the cross member 30 may be disposed closer to a lower surface 58 of the table top 12 when the cross member is in the first, locked position. The cross member 30, however, may be spaced apart from the lower surface 58 of the table top 12 when the cross member is in the second, unlocked position. Desirably, because the cross member 30 may be disposed closer to the lower surface 58 of the table top 12 when the cross member is in the first position, this may allow the table top to have smaller and/or shorter features (such as the receiving and engaging portions 52, 54), which may advantageously reduce the amount of plastic needed to construct the table top.

As shown in FIGS. 7 and 10, the first and second portions 36, 38 of the hinges 32, 34 may include brackets 60, 62. The brackets 60, 62 may include flanges 64, 66, 68, 70, respectively, and an intermediate portion may be connected to and extend between the flanges. As shown in the accompanying figures, the fastener 40 may connect the flanges 64, 68, which may allow the brackets 60, 62 to move about an axis between an unfolded position and a folded position. In addition, the openings 44, 46 may be disposed in the flanges 66, 70 of the brackets 60, 62. It will be appreciated that the hinges 32, 34 may have other suitable shapes, sizes, configurations or arrangements, depending, for example, upon the intended use of the table 10.

As best seen in FIGS. 6-10, a connector 72 may be used to facilitate and/or control movement of the end 42 of the cross member 30 within the openings 44, 46 of the hinges 32, 34. In particular, the connector 72 may be connected to the hinge or other suitable portion of the table by a fastener 74, such as a pin or projection, disposed within an opening 76. The cross member 30 may be disposed within a passageway 78 of the connector 72 and a fastener 80 may be used secure the cross member to the connector. It will be appreciated the connector 72 is not required and that the cross member 30 may be connected to other suitable portions of the table 10. It will also be appreciated the connector 72 may have a variety of other suitable components and/or configurations.

The connector 72 may help facilitate and/or control movement of the cross member 30 along an arc or curved path. Accordingly, the openings 44, 46 in the hinges 32, 34 may have corresponding curved surfaces. It will be appreciated the openings 44, 46 do not require curved surfaces and the openings may have other suitable configurations and arrangements.

Figure 6:
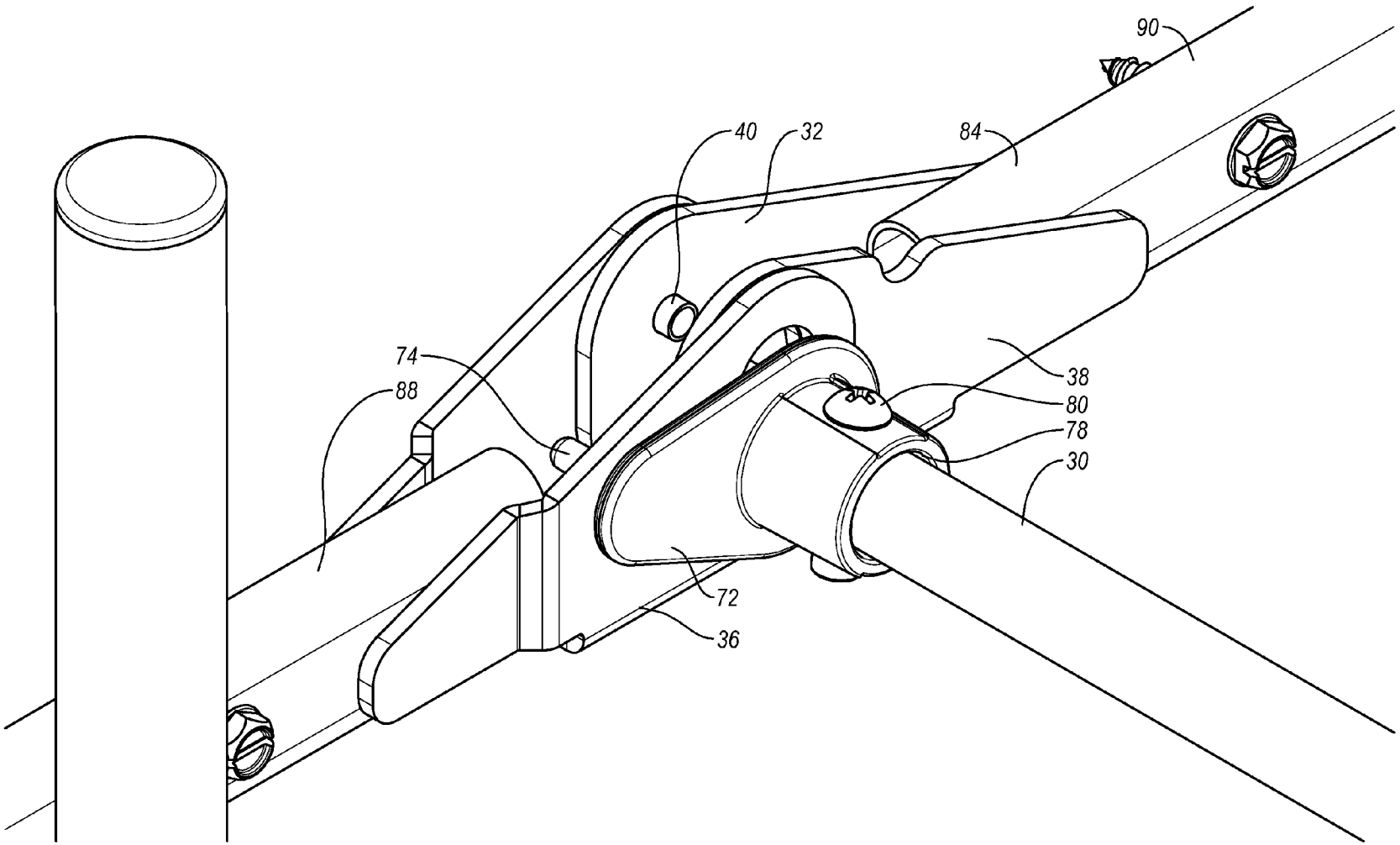
FIG. 6 is an enlarged perspective view of a portion of the table shown in FIG. 5.

As discussed above and shown in FIG. 2, the hinges 32, 34 may be connected to and/or form part of a frame 82. For example, the first hinge 32 may be connected to a first rail 84 and the second hinge 34 may be connected to a second rail 86 of the frame 82. In greater detail, as shown in FIGS. 6 and 7, the first portion 36 of the hinge 32 may be connected to a first section 88 of the first rail 84 and the second portion 38 of the hinge may be connected to a second section 90 of the rail.

As mentioned above, the cross member 30 may be located closer to the lower surface 58 of the table top 12 when the legs 14, 16 are in the extended position. On the other hand, the cross member 30 may be disposed farther from the lower surface 58 of the table top 12 when the legs 14, 16 are in the collapsed position. As shown in FIG. 14, all or at least a substantial portion of the cross member 30 may be generally disposed between a lower or bottom surface 92 of the frame 82 (such as the rails 86, 88) and the lower surface 56 of the table top 12 when the legs 14, 16 are in the extended position. When the legs 14, 16 are in the collapsed position, all or at least a portion of the cross member 30 (such as about thirty percent, forty percent, fifty percent or more) may extend below the bottom surface 92 of the frame 82. Because at least a portion of the cross member 30 may be disposed between the bottom surface 92 of the frame 82 and the lower surface 56 of the table top 12 when the cross member is in the first or second positions, this may allow the table top to have a shorter and/or smaller lip 94, which may advantageously reduce the amount of plastic needed to construct the table top.

As shown in FIG. 4, the table 10 may include a handle 95. The handle 95 is preferably formed in the first and second sections 26, 28 of the table top 12. Advantageously, if the table top 12 is formed from plastic using a molding process (such as blow molding, injection molding or the like), then at least a portion of the handle 95 may be integrally formed in the table top as part of a unitary, one-piece structure during the molding process. As shown in the accompanying figures, the handle 95 may include an access opening in an outer edge of the second table top section 28 which is generally aligned with a recess in an outer edge of the first table top section 26. This may allow the handle 95 to be easily grabbed when the table top 12 is in the folded position. Preferably the access opening and the gripping area of the handle 95 are disposed between the edge of the table top 12 and the frame 82. The handle 95 may be independent and spaced apart from the 82, and the handle may not require any separate or additional structures other than what was formed in the table top 12. In addition, the handle 95 preferably has a length that is at least about three to four inches long. It will be appreciated the handle 95 may have other suitable shapes, sizes, configurations and arrangements. For example, other suitable handles and accompanying features may be disclosed in U.S. Pat. Nos. 8,091,490 and 8,166,894; each of which is incorporated by reference in its entireties. It will also be appreciated that a handle is not required.

Figure 12:
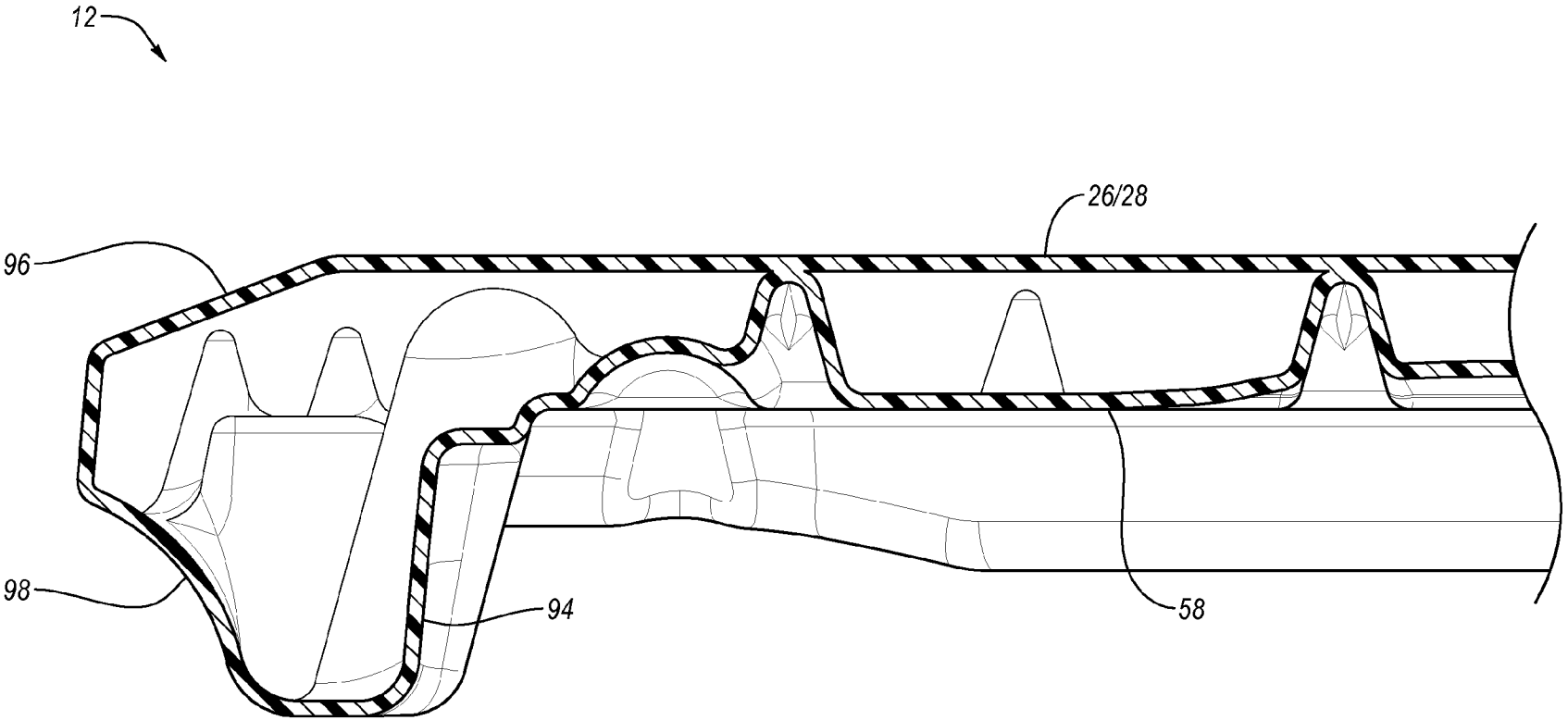
FIG. 12 is an enlarged cross-sectional view of a portion of the table shown in FIG. 11.

As shown in FIGS. 11 and 12, the outer edges of the table top 12 may be slanted or tapered. In particular, the outer edges of the table top may include arched, chamfered and/or scooped-out upper and/or lower portions 96, 98. For example, as shown in the accompanying figures, the upper portion 96 of the outer edge may be slanted, curved, angled or tapered downwardly. Additionally, at least a portion of the lower portion 98 of the outer edge may be slanted, curved, angled or tapered upwardly. The upper and lower portions 96, 98 of the outer edges of the table top 12 are preferably at least partially vertically aligned or overlapping. Thus, for example, the upper portion 96 may be angled downwardly and the lower portion 98 may be angled upwardly, which may help create a table top 12 with a thinner outer edge. Further, one or more tack-offs or depressions may be formed in the lower portion 98 of the outer edge. If desired, all or at least a portion of one or more depressions may be disposed in the generally aligned upper and lower portions 96, 98 of the outer edge of the table top 12.

The lower portion 98 of the outer edge may also include a downwardly extending lip 99. As shown in the accompanying figures, at least a portion of one or more of the depressions may be formed in the lip 99. In particular, a portion of the depressions may be formed in an inner wall of the lip 99. Therefore, the lower portion 98 of the edge of the table top 12 may include an angled surface, one or more depressions and/or a lip 99, if desired. Advantageously, the angled surface, depressions and/or lip 99 of the lower portion 98 may be sized and configured to increase the strength and/or rigidity of the outer edge of the table top 12.

While the table top 12 may include both the upper and lower portions 96, 98, it will be appreciated the table top may only include the angled upper portion 96. If desired, one or more depressions may be formed in the lower surface and these depressions may be aligned with and/or support the angled upper portion 96. These depressions may be substantially or entirely disposed below the angled upper portion 96. The table top 12 may also only include the angled lower portion 98. One or more depressions may be substantially or entirely disposed in the angled lower portion 98.

Significantly, the angled upper and lower portions 96, 98 may allow a thinner outer edge of the table top 12 to be created. This edge configuration may allow the table top 12 to be molded with less plastic, which may decrease the weight of the table top. In addition, because the plastic may travel a shorter distance during the molding process, less plastic may be used and it may be easier to manufacture. Further, although the table top 12 may have a thinner outer edge, the angled upper and lower portions 96, 98 and the depressions disposed within the upper and lower portions may allow a strong and resilient edge of the table top 12 to be created. This configuration may also allow the size of the outer lip 99 to be significantly decreased or eliminated, if desired.

The thinner edges of the table top 12 and the small size of the features formed in the table top, such as the receiving portion 52 and the engaging portion 54, may allow the table 10 to be constructed with less plastic than conventional tables with blow-molded plastic table tops. In particular, the features of the table 10 may allow the table top 12 to be constructed from blow-molded plastic with a thinner outer wall than conventional blow-molded plastic table tops. As discussed above, various features of the table top 12 have been specifically designed to decrease the amount of plastic required to form the features. Consequently, the table top 12 requires significantly less plastic than conventional blow-molded plastic table tops of the same size. For example, previous utility tables of a conventional size had an edge thickness of 2⅛ inches and required about 6.9 kg of plastic to manufacture. Other known utility tables of the same size had an edge thickness of 1¾ inches and required about 6.4 kg of plastic to manufacture. The table top 12 disclosed herein may have the same size as the previous utility tables, but it may have an edge thickness of about 1½ inches and require only about 5.4 kg of plastic to manufacture. Therefore, the table top 12 provides a significant reduction in the weight of the table top, which may reduce transportation costs, and a substantial decrease in the amount of plastic required to form the table top. This may reduce material costs, save resources and decrease the cost of the table 10.

If the table top 12 is constructed from molded plastic, one or more features may be integrally formed in the table top 12 as part of a unitary, one-piece structure during the molding process. For example, the receiving portion 52, the engaging portion 54, the handle 94; the angled upper portion 96; the angled lower portion 98 and/or other features may be integrally formed in the table top 12 as part of a unitary, one-piece during the molding process. It will be appreciated the table top 12 and other features may be formed using other suitable materials and processes.

The legs 14, 16 and brace assemblies 48, 50 are preferably constructed from metal. As shown in FIG. 1, the brace assemblies 48, 50 may have a generally Y-shaped configuration including supports 100, 102 and an elongated body 104. The supports 100, 102 and elongated body 104 may be constructed from metal tubes, which may advantageously reduce manufacturing costs. In particular, the supports 100, 102 may be formed by flattened metal tubes. It will be appreciated the legs 14, 16 and the brace assemblies 48, 50 may be constructed from other suitable materials.

Advantageously, the table 10 may be easy to use, store and transport. In addition, the table top 12 may be automatically locked in the unfolded position when the legs 14, 16 are disposed in the extended position. This locking of the table top 12 in the unfolded position may also help aligned and position the first and second sections 26, 28 of the table top in the desired position. Further, because the inner edges of the first and second sections 26, 28 of the table top 12 may be connected and/or securely engaged, the center portion of the table 10 may be fully supported.

In operation, the user may simply unfold the table top 12 so that the first and second table top sections 26, 28 are disposed in generally the same plane. The user can then move the legs 14, 16 from the collapsed to the extended position. As the legs 14, 16 are moved from the collapsed to the extended position, the brace assemblies 48, 50 preferably move from the storage position to the use position. This movement of the brace assemblies 48, 50 may move the cross member 30 from the unlocked position to the locked position in which the cross member resists folding of the table top 12. The movement of the legs 14, 16 preferably automatically and simultaneously moves the brace assemblies 48, 50 and the cross member 30. A locking ring 110 as shown in FIG. 1, or other suitable mechanism, may be used to secure the legs 14, 16 in the extended position.

In order to move the table 10 from the use position shown in FIG. 1 to the collapsed position shown in FIG. 4, the legs 14, 16 may be moved from the extended position to the collapsed position. This movement of the legs 14, 16 preferably causes the brace assemblies 48, 50 to move the use to the storage position, and the cross member 30 to move from the locked to the unlocked position. The user may then fold the table top 12 in half. Significantly, folding and unfolding of the table 10 may be very efficient, straightforward and quickly performed.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a foldable table top comprising a first section and a second section, the first section and the second section movable about an axis of rotation between an unfolded position and a folded position, the first and second sections generally aligned in the same plane in the unfolded position, the first and second sections generally disposed adjacent and parallel to each other in the folded position;

an inner surface of the first section of the table top;

an inner surface of the second section of the table top, the inner surface of the first section of the table top and the inner surface of the second section of the table top being disposed at least adjacent when the table top is in the unfolded position;

a projection extending from the first section of the table top;

a recess in the second section of the table top, the projection being at least partially disposed in the recess when the table top is in the unfolded position;

a receiving portion at least partially disposed in an outer surface of the projection;

a cross member disposed at least proximate and movable relative to a lower surface of the table top, the cross member movable between a locked position and an unlocked position, the cross member disposed in the receiving portion of the projection when the table top is in the unfolded position and the cross member is in the locked position, the cross member spaced apart from the receiving portion of the projection when the table top is in the unlocked position; and one or more support members connected to the table top, the support members movable between a use position in which the support members support the table top and a collapsed position in which the support members are disposed at least proximate the table top;

wherein the table top is locked in the unfolded position when the cross member is disposed in the receiving portion of the projection and in the locked position.

2. The table as in claim 1, wherein the cross member is not aligned with the axis of rotation of the table top when the cross member is disposed in the receiving portion of the projection, the table top is in the unfolded position and the table top is in the locked position.

3. The table as in claim 1, wherein the cross member is aligned with the axis of rotation of the table top when the cross member is spaced apart from the receiving portion of the projection and the table top is in the unlocked position.

4. The table as in claim 1, wherein the cross member engages the receiving portion of the projection when the cross member is in the locked position; and wherein the engagement of the cross member and the receiving portion creates an interference fit between the projection and the recess.

5. The table as in claim 1, wherein the cross member engages the receiving portion of the projection when the cross member is in the locked position; and wherein the engagement of the cross member and the receiving portion resiliently deforms at least a portion of the projection.

6. The table as in claim 1, wherein the cross member engages the receiving portion of the projection when the cross member is in the locked position; and wherein the engagement of the cross member and the receiving portion biases the projection towards the recess.

7. The table as in claim 1, further comprising:

a projection extending from the inner surface of the second section of the table top;

a recess in the inner surface of the first section of the table top, the projection being at least partially disposed in the recess when the table top is in the unfolded position;

a receiving portion at least partially disposed in an outer surface of the projection of the second section of the table top; and the cross member disposed in the receiving portion of the projection of the second section of the table top when the table top is in the unfolded position and the cross member is in the locked position, the cross member spaced apart from the receiving portion of the projection of the second section of the table top when the table top is in the unlocked position.

8. The table as in claim 1, wherein the cross member is a first distance away from the table top in the first position; and wherein the cross member is a second distance away from the table top in the second position.

9. The table as in claim 1, wherein the projection and the recess overlap when the table top is in the unfolded position.

10. The table as in claim 1, wherein the projection and the recess interlock when the table top is in the unfolded position.

11. A table comprising:

a foldable table top comprising a first section and a second section, the first section and the second section movable between an unfolded position and a folded position, the first and second sections generally aligned in the same plane in the unfolded position, the first and second sections generally disposed adjacent and parallel to each other in the folded position;

a hinge connecting the first section of the table top and the second section of the table top, the hinge providing an axis of rotation for the table top between the folded and the unfolded positions; and a cross member including a first portion disposed within an opening in the hinge, the cross member movable within the opening in the hinge between a first position in which the cross member is not aligned from the axis of rotation and a second position in which the cross member is aligned with the axis of rotation;

wherein the cross member resists folding of the table top in the first position because the cross member is not aligned with the axis of rotation; and wherein the cross member facilitates folding and unfolding of the table top in the second position because the cross member is aligned with the axis of rotation.

12. The table as in claim 11, further comprising a leg assembly movable between an extended position and a collapsed position relative to the first section of the table top; and a brace assembly connecting the leg assembly and the cross member;

wherein movement of the leg assembly towards the extended position moves the locking member towards the first position because the movement of the leg assembly towards the extended position moves the brace assembly from a collapsed position to an extended position.

13. The table as in claim 11, further comprising a leg assembly movable between an extended position and a collapsed position relative to the first section of the table top; and a brace assembly connecting the leg assembly and the cross member;

wherein movement of the leg assembly towards the collapsed position moves the locking member towards the second position because the movement of the leg assembly towards the collapsed position moves the brace assembly from an extended position to a collapsed position.

14. The table as in claim 11, further comprising a leg assembly movable between an extended position and a collapsed position relative to the first section of the table top; and a brace assembly connecting the leg assembly and the cross member;

wherein movement of the leg assembly between the use and collapsed positions moves the cross member between the first and second positions because the movement of the leg assembly towards the extended position moves the brace assembly from a collapsed position to an extended position and because the movement of the leg assembly towards the collapsed position moves the brace assembly from the extended position to the collapsed position.

15. The table as in claim 11, wherein the opening in the hinge is an elongated slot that allows the cross member to move along a curved path between the first position and the second position.

16. A method of using a table, the table including a foldable table top including a first section and a second section connected by a hinge, the first and second sections of me table top movable about an axis of rotation between an unfolded position in which the first and second sections are generally aligned in the same plane and a folded position in which the first and second sections are generally disposed adjacent and parallel to each other, a leg assembly movable between an extended and collapsed position relative to the first section of the table top, a cross member connected to the hinge, the cross member movable between a first position in which the cross member is not aligned and spaced apart from the axis of rotation to prevent folding of the table top and a second position in which the cross member is aligned with the axis of rotation to facilitate folding and unfolding of the table top, and a brace assembly connected to the leg assembly and the cross member, the method comprising:

moving the leg assembly from the extended position to the collapsed position relative to the first section of the table top;

wherein the movement of the leg assembly between the extended position and the collapsed position moves the cross member between the first position and the second position.

17. The method as in claim 16, wherein the moving of the leg assembly between the extended position and the collapsed position moves the cross member to the first position.

18. The method as in claim 16, wherein the moving of the leg assembly between the extended position and the collapsed position moves the cross member to the second position.

19. The method as in claim 16, wherein the table further comprises a brace assembly movable between an extended position and a collapsed position, the brace assembly including a first end connected to the leg assembly and a second end connected to the cross member, the brace assembly disposed in the extended position when the leg assembly is in the extended position, the brace assembly disposed in the collapsed position when the leg assembly is in the collapsed position.

20. The method as in claim 16, wherein the cross member is a first distance away from the table top in the first position and the cross member is a second distance away from the table top in the second position.

* * * * *

UNITED STATES PATENT AND TRADEMARK OFFICE

CERTIFICATE OF CORRECTION

PATENT NO. : 8,726,817 B2
APPLICATION NO. : 13/846659
DATED : May 20, 2014
INVENTOR(S) : Bennett et al.

It is certified that error appears in the above-identified patent and that said Letters Patent is hereby corrected as shown below:

In the Specification

In Column 11, Line 40, delete "lower surface 56" and insert -- lower surface 58 --, therefor.

In Column 11, Line 47, delete "lower surface 56" and insert -- lower surface 58 --, therefor.

In Column 13, Line 27, delete "handle 94;" and insert -- handle 95; --, therefor.

Signed and Sealed this
Second Day of September, 2014

Michelle K. Lee

Michelle K. Lee
*Deputy Director of the United States Patent and Trademark Office*